United States Patent [19]

Noack

[11] 4,354,773

[45] Oct. 19, 1982

[54] GROUND COVERING ELEMENT HAVING RAISED PORTIONS AT THE USEFUL SIDE WHICH ARE SEPARATED FROM ONE ANOTHER BY DUMMY GAPS, A GROUND COVERING ELEMENT GROUP OF SUCH GROUND COVERING ELEMENTS, AND A METHOD OF PRODUCING SUCH GROUND COVERING ELEMENTS

[75] Inventor: Fritz Noack, Pforzheim, Fed. Rep. of Germany

[73] Assignees: Dr. Barth GmbH, Karlsruhe; F. von Langsdorff Bauverfahren GmbH, Rastatt, both of Fed. Rep. of Germany

[21] Appl. No.: 121,511

[22] Filed: Feb. 14, 1980

[30] Foreign Application Priority Data

Feb. 15, 1979 [DE] Fed. Rep. of Germany ..... 2905796

[51] Int. Cl.[3] ..... E01C 5/00

[52] U.S. Cl. ..... 404/41

[58] Field of Search ..... 404/41, 34

[56] References Cited

U.S. PATENT DOCUMENTS

| | | | |
|---|---|---|---|
| 1,045,328 | 11/1912 | Sammis | 404/41 |
| 3,891,340 | 6/1975 | Bolli | 404/34 |
| 3,922,105 | 11/1975 | Bolli | 404/34 |

FOREIGN PATENT DOCUMENTS

| | | | |
|---|---|---|---|
| 821827 | 9/1969 | Canada | 404/41 |
| 2087 | 10/1877 | Fed. Rep. of Germany | 404/41 |
| 727362 | 11/1942 | Fed. Rep. of Germany . | |
| 960359 | 3/1957 | Fed. Rep. of Germany . | |
| 1790054 | 6/1959 | Fed. Rep. of Germany . | |
| 1459724 | 12/1968 | Fed. Rep. of Germany . | |
| 1534201 | 2/1969 | Fed. Rep. of Germany | 404/41 |
| 7139503 | 1/1972 | Fed. Rep. of Germany . | |
| 1459739 | 2/1973 | Fed. Rep. of Germany . | |
| 7318305 | 8/1973 | Fed. Rep. of Germany . | |
| 2251621 | 5/1974 | Fed. Rep. of Germany . | |
| 2259493 | 6/1974 | Fed. Rep. of Germany . | |
| 7431339 | 1/1975 | Fed. Rep. of Germany . | |
| 2337816 | 3/1975 | Fed. Rep. of Germany . | |
| 2356742 | 5/1975 | Fed. Rep. of Germany . | |
| 2401303 | 7/1975 | Fed. Rep. of Germany | 404/41 |
| 2416547 | 10/1975 | Fed. Rep. of Germany | 404/41 |
| 2440177 | 3/1976 | Fed. Rep. of Germany | 404/41 |
| 2452475 | 5/1976 | Fed. Rep. of Germany . | |
| 7633888 | 4/1977 | Fed. Rep. of Germany . | |
| 2608871 | 9/1977 | Fed. Rep. of Germany . | |
| 2710449 | 9/1977 | Fed. Rep. of Germany . | |
| 7428377 | 9/1977 | Fed. Rep. of Germany . | |
| 7712154 | 7/1978 | Fed. Rep. of Germany . | |
| 2732452 | 2/1979 | Fed. Rep. of Germany . | |
| 753115 | 10/1933 | France | 404/34 |
| 51203 | 5/1941 | Netherlands | 404/34 |
| 89587 | 6/1958 | Netherlands | 404/34 |
| 484345 | 5/1938 | United Kingdom | 404/34 |

*Primary Examiner*—Rodney H. Bonck

*Attorney, Agent, or Firm*—Spencer & Kaye

[57] ABSTRACT

A ground covering element adapted for positioning adjacent another ground covering element. The outer contour of the ground covering element forms projections and recesses about its entire periphery, has corner projections which form the vertices of a rectangle and line portions all of which are oblique to the sides of the rectangle connecting the corner projections. At least two of the line portions connecting each of the vertices are of equal length and the remaining line portions have lengths which are integer multiples of the lengths of the at least two line portions of equal length. A plurality of irregular spaced polygons project from the top surface to form raised portions, the majority of the polygons differing in shape from each other. The edges of the raised portions are straight and separated from each other by dummy gaps having widths which vary linearly along the entire length thereof and from the periphery of the ground covering element by marginal dummy gaps. The edge of each raised portion adjacent the periphery of the element substantially follows the contour thereof and has a distance therefrom such that the average distance between the edge of the raised portion adjacent the periphery and the contour is approximately equal to the average width of the dummy gaps between the raised portions. Sand is used to fill the space between the adjacent ground covering elements thereby effectively concealing this space from view.

11 Claims, 5 Drawing Figures

GROUND COVERING ELEMENT HAVING RAISED PORTIONS AT THE USEFUL SIDE WHICH ARE SEPARATED FROM ONE ANOTHER BY DUMMY GAPS, A GROUND COVERING ELEMENT GROUP OF SUCH GROUND COVERING ELEMENTS, AND A METHOD OF PRODUCING SUCH GROUND COVERING ELEMENTS

FIELD OF THE INVENTION

The present invention relates to a ground covering element having raised portions at the useful side which are separated from one another by dummy gaps and which are provided in a plurality of different formats, as seen from above. In accordance with the invention the term "format" is used to designate the shape and/or size of the raised portions.

BACKGROUND OF THE INVENTION

In a known ground covering element of this kind (German utility model DE-Gbm No. 73 18 305) the raised portions are of circular shape, as seen from above. If such circular raised portions are located even so closely together that mutual contact is established between them, relatively large depressed portions, shaped like triangles with concavely rounded sides, still remain free between the raised portions. These recessed portions and the circular shape of the raised portions are not very practical for various reasons. For example, water drainage is obstructed by the mutual contact between the raised portions, foreign matter may be pressed rather easily into the deeper areas, and material chipping off the edges of the raised portions changes the ground covering element disadvantageously under aesthetical aspects.

SUMMARY OF THE INVENTION

It is, therefore, the object of the present invention to provide a ground covering element which is better adapted to practical needs and the concept of which offers the opportunity of designing the recessed portions between the raised portions so as to be better adapted to the respective requirements.

To meet this object it is provided, in accordance with the invention, that at least the majority of the raised portions, preferably however all raised portions, essentially have the format of an irregular polygon, as seen from above.

Based on this concept of the invention it is possible to design the dummy gaps or recessed portions between the raised portions, as seen from above, in accordance with the particular requirements as to shape and size, thereby avoiding disadvantages of the above mentioned kind, such as obstructing the drainage of water or stepping inadvertently into the recessed portions with pointed heels, clamping the wheels of baby carriages in the recessed portions, and the like. In addition an advantage is obtained in that chips of material breaking loose either along the circumference of the ground covering elements or at the edges of the raised portions, as experience shows, in the course of the manufacture, loading, in particular unloading by tipping of a dump truck, and during the handling of the ground covering elements, are no longer disturbing, either functionally or optically, since they fall in line with the irregular polygonal shape of the raised portions. The same applies analogously to changes in the appearance of the color, such as efflorescences or concrete discolorations if the ground covering elements are made of concrete. It is also true in the event that the molds for forming the ground covering elements are worn to a certain extent. The fact that then the exact form of the ground covering elements can no longer be observed with the same accuracy as in the case of a new mold, no longer presents a functional or optical disadvantage. Furthermore, greatly damaged or even broken ground covering elements still may be used readily for repair or paving along the edges of a surface area to be covered so that the amount of waste is reduced.

The ground covering elements in accordance with the invention are used, above all, for paving streets, courtyards, places, sidewalks, driveways, embankments, water courses, and the like. They are made in particular of concrete.

The term "irregular polygon" in the first place is meant to designate polygons which do not have the same corner angle, measured inside the polygon, at all corners. The irregularity is greater, when there is no axial symmetry and/or radial symmetry for the polygons. In accordance with another alternative the raised portions are realized as irregular polygons by giving their edges an irregular course, such as wavy, serrated, or otherwise nonlinear. In this case the polygons are irregular polygons even if all corner angles, measured inside the polygon, are the same at all the corners of the polygon.

Preferably, at least part of the edges of the raised portions facing the contour of the ground covering element are adapted to the contour of the ground covering element. The corresponding part of the edges of the raised portions thus is to extend at least essentially in accordance with the contour of the ground covering element, specifically substantially parallel to said contour.

Projections and recesses in the contour of the ground covering element with respect to an assumed baseline, for instance the baseline of a rectangle which, preferably, may be twice as long as it is wide permit the ground covering element to become interlocked with adjacent ground covering elements during the laying in a manner which stabilizes the position. The projections and recesses, for example, may be rectilinear, rounded or rectilinear and rounded, regular or irregular or, preferably, rectilinear and regular. Preferably, the projections and recesses are so arranged that the resulting contour of the ground covering element is of the kind of the outline of an interlocking stone. The most complete interlocking effect of adjacent ground covering elements is obtained if the outline of the interlocking stone is so designed that one ground covering element can clamp together two adjacent ground covering elements, at least in respect of part of the sides of the circumference of the ground covering element.

Preferably, at least part of the raised portions have an uneven surface structure. This applies to a degree of roughness beyond the usual unevenness of the material of ground covering elements, for instance the usual roughness of concrete. Examples for this structure are the intentional rougher design of the surfaces, a pitted surface, and the imitation of a natural fractured rough surface. The surface structure may also be obtained by finishing of the surface, such as grinding, in particular in a manner which will leave depressions below the grinding plane in the raised portions, furthermore, sandblasting, washing-out, and the like.

As seen from above, preferably, at least part of the edges of the raised portions facing the contour of the ground covering elements are spaced from the contour of the ground covering element. Hereby the corresponding edges which are exposed to the greater risk of breaking or chipping off no longer are disposed in the particularly endangered zone directly at the circumference of the ground covering element. It is especially favorable to make this distance approximately half as wide as the remainder of the dummy gap width if the width of the dummy gaps varies, or to make it approximately half as wide as the average dummy gap width if the ground covering element has dummy gaps of different widths. If ground covering elements are placed one beside the other, this measure will provide a distance between the edges of the raised portions of adjacent ground covering elements, which edges face the contour of the respective ground covering element. This distance corresponds approximately to the dummy gap width or to the average dummy gap width within the ground covering elements, if desired, in consideration of the sand placed between adjacent ground covering elements.

Not all dummy gaps of a ground covering element must have the same depth. Instead, it is also possible to provide at least two dummy gaps of different depth. This has not only optical aspects but also advantages as to the loading capacity in that, for instance, dummy gaps of less depth can be selected for places of higher anticipated stress.

It is also possible to provide dummy gaps whose depth varies in the direction of their longitudinal extension, for instance, so as to obtain the same advantages as mentioned in the preceding paragraph. It may even be provided that at some places the dummy gaps extend as far as the side opposite the useful side of the ground covering element. The resulting interruptions are favorable, for example, for the drainage of water.

In general the ground covering element is weakened in the areas of the dummy gaps as the thickness of material measured from the useful side to the opposite side is less in comparison with the raised portions. This weakening intentionally may be carried to such a point that the material connections interconnecting the raised portions below the dummy gaps present facultative breaking zones. To this end, for instance, the dummy gaps may be designed to be relatively deep, the bottom of the dummy gaps may be wavy, serrated or the like, for instance in accordance with the laid open German patent application DE-OS No. 22 59 493 or German patent DE-PS No. 22 59 493, the dummy gap sections extending as far as the side opposite the useful side may be provided in corresponding size and/or number, or the dummy gaps may be given a corresponding width. The facultative breaking zones according to this further development of the invention should be so designed that they present places at which the ground covering element will break first after the laying when subjected to corresponding high stress by traffic or thermal loads or vibrations. This will prevent the formation of random cracks through the raised portions. Instead, the resulting ground covering reacts flexibly, so to speak, to changes of the underground.

The invention further relates to a ground covering element group consisting of ground covering elements of the kind defined above. Preferably, all ground covering elements of the group of ground covering elements have the same contour.

Particular reference should be made to the possibility of further development embodied by the fact that a plurality of ground covering elements of the ground covering element group are combined in a laying unit by material connections which may be so designed, at least in part, that they present facultative breaking zones in the sense explained above. If part or all of the material connections between the ground covering elements of the ground covering element group as well as part or all of the material connections between the raised portions of the individual ground covering elements present facultative breaking zones, then the corresponding material connections between the ground covering elements of the ground covering element group preferably are designed to be less stable so that breakage is more likely to occur here than between the raised portions of the respective ground covering elements.

The term ground covering element group is intended to designate in particular (a) a random section of a greater arrangement of ground covering elements, or as alternative (b) a ground covering element group defined by the entire surface area which is integrally covered, or as alternative (c) a ground covering element group joined in a laying unit by connections of material, or as alternative (d) a ground covering element group defined by the number of ground covering elements, for instance, less than fifty ground covering elements, less than twenty ground covering elements, or less than ten ground covering elements. Typical dimensions of ground covering elements are a length up to 50 cm and a width up to 25 cm.

The invention finally also relates to a method of producing the ground covering elements described above. Useually ground covering elements of concrete are formed mechanically in corresponding molds, a plurality of the same being arranged side by side. In accordance with the invention it may be provided that at least two kinds of ground covering elements which differ as to shape of the raised portions and/or surface structure of the raised portions are formed at the same time in one operation of producing ground covering elements side by side. This can be realized in simple manner in that the rams forming the useful side of the ground covering elements have a surface design complementary to the shape and/or surface structure of the raised areas. This is a simple manufacturing method by means of which the effect of disaggregation and irregularity of the covering in laid condition in accordance with the invention is obtained.

If the ground covering element in accordance with the invention has raised portions of different format, as seen from above, in the extreme case these may be only two different formats. Preferably, however, a plurality of different formats are provided for the raised portions. Especially preferred is a design in which all the raised portions of a ground covering element have different formats.

The expressions "at least part", "at least in part" or the like as used herein mean that at least the major part has the respective design mentioned. Most preferably all of the respective areas, dummy gaps, edges, material connections, and the like mentioned are of the particular design. The dummy gaps preferably are so provided that at least some, preferably all of them do not extend along a straight line from an edge of the contour of the ground covering element to the opposite edge of the contour of the ground covering element. On the one hand, this provides an aesthetically pleasing disaggregated picture and, on the other hand, it is also favorable as regards the loading capacity since the diminished cross sections are not rectilinearly continuous. By the way, the concept of the invention makes it possible for the ground covering element according to the invention to be so designed that in laid condition it will create the impression as if a surface area was covered with natural stones.

Examples of favorable contours of the ground covering elements according to the invention may be taken from the embodiments described below. The ground covering element groups in accordance with the invention may comprise individual or several features known from the laid open German patent applications DE-OS No. 22 51 621, 22 59 493, 23 37 816, 24 52 475, 27 32 452, in particular from the claims thereof.

BRIEF DESCRIPTION OF THE DRAWINGS

The invention and further developments of the invention will be described in greater detail below with reference to an embodiment of a ground covering element and an embodiment of a ground covering element group. In the drawings.

In the figures, the same reference numerals are used to designate the same or analogous items.

DESCRIPTION OF PREFERRED EMBODIMENTS

Figure 1:
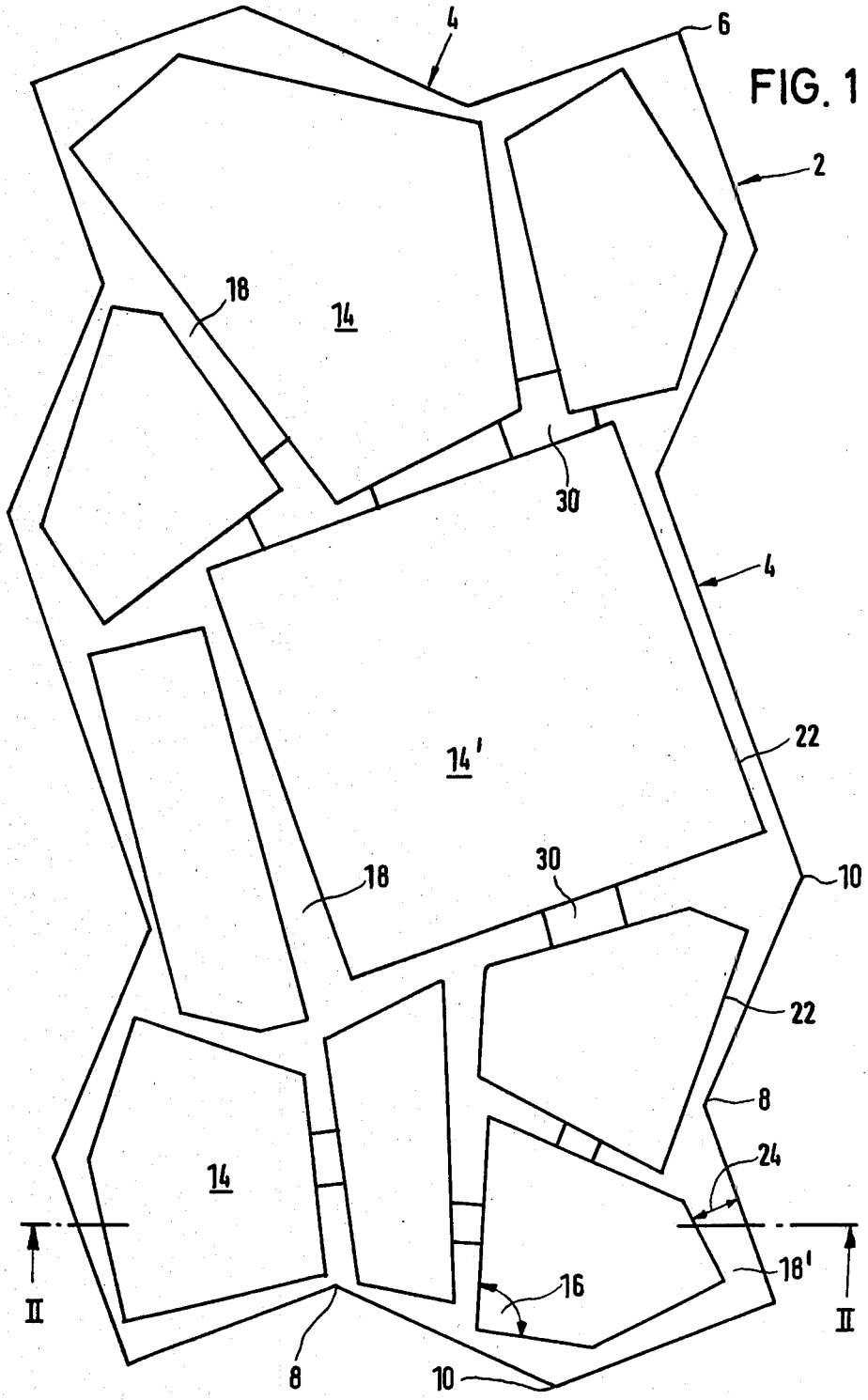
FIG. 1 is a top view of a ground covering element.
Figure 2:
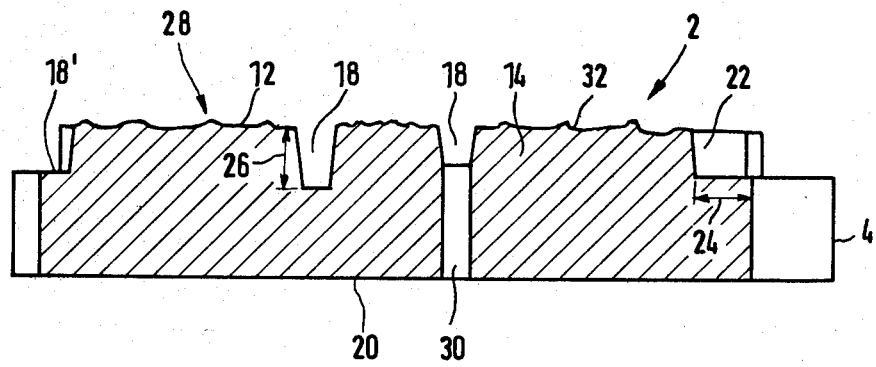
FIG. 2 is a cross section along line II—II in FIG. 1.

The ground covering element 2 shown in FIGS. 1 and 2 has a contour 4 of the kind of the outline of an interlocking stone. With respect to the baseline of a rectangle not shown in the drawing and interconnecting the four rectangular outer corners 6 of the ground covering element 2 and being twice as long as it is wide, this contour 4 has two recesses 8 and two projections 10 each at the long sides and one recess 8 and one projection 10 each at the short transverse sides. The contour 4 of the ground covering element 2 as shown is known per se and described in greater detail in German patent DE-PS No. 14 59 739 to which reference is made here.

On its useful side 12 which is visible in the top view of FIG. 1, the ground covering element 2 has nine raised portions 14. With the exception of a single raised portion 14' which is essentially square, all raised portions 14 are provided in the format of irregular polygons. In none of the irregular polygons 14 do all corner angles 16, measured inside the polygon, have the same size. Instead, within each irregular polygon 14 corner angles 16 of different sizes follow each other according to no rule. Therefore, it may also happen, for instance, that several corner angles 16 have the same size.

The raised portions 14 are separated from one another by dummy gaps 18. The dummy gaps 18 extend approximately through one third of the total thickness of the ground covering element, as measured from the useful surface of the raised portions 14 to the opposite side 20. Most of the dummy gaps 18 have a width which varies in the longitudinal direction of the dummy gap. The sidewalls of the dummy gaps extend at a slight inclination toward the inside so as to facilitate removal from the mold during manufacture (FIG. 2).

The edges 22 of the raised portions 14 facing the contour of the ground covering element 2 do not coincide with the corresponding section of the outline but are offset toward the inside with respect to the contour 4 by a distance 24. In analogy to the dummy gaps 18 in the interior of the ground covering element 2, the resulting step is likewise designated dummy gap or marginal dummy gap 18'. The edges 22 are adapted to the contour 4 of the ground covering element in the sense that they roughly follow the contour 4. In the case of the polygon 14' this goes as far as having the edge 22 extend in parallel with the corresponding section of the contour 4, whereas at all other locations the marginal dummy gaps 18' are of varying widths in longitudinal direction of the marginal dummy gaps. In the embodiment shown the extent of adaptation of the edges 22 to the contour 4 goes so far that with another ground covering element 2 laid to abut the first one, again gaps like the dummy gaps 18 are formed. These, however, are continuous down to the lower side 20 between the two contours 4 of the adjacent ground covering elements 2 like actual joints. The distances 24 roughly correspond essentially to half the width of the dummy gaps 18 in the interior of the ground covering element 2, upon suitable averaging of the width.

FIG. 2 shows clearly that the dummy gaps 18 of the ground covering element 2 are of different depths 26. The left dummy gap, as seen in FIG. 2, is approximately 50% deeper than the right dummy gap 18 in FIG. 2. The marginal dummy gaps 18', on the other hand, have the same depth all around.

The individual dummy gaps 18 in part are of varying depth such that at some locations they extend as far as the lower side 20 of the ground covering element 2 opposite the useful side 28. The break-throughs or interruptions thus formed are marked 30. At two locations at the top of FIG. 1 it is shown that these interruptions 30 may be provided, for example, at those locations at which three raised portions 14 come together. Similarly or in addition the interruptions 30 could also be provided at locations at which four or more raised portions 14 come together. At the bottom of FIG. 1 another possibility is shown in the drawing. There the interruptions 30 are each provided in the central range of the length of the dummy gaps 18 between two adjacent raised portions 14.

It may be taken from FIG. 2 that the surfaces of the raised portions 14 have an intentionally uneven surface structure 32. This surface structure changes from one raised portion 14 to another raised portion 14. FIG. 2 shows three different surface structures. In the extreme case all raised portions 14 and 14' of the ground covering element 2 could have different surface structures 32. The surface structures shown in FIG. 2 may be said to be pitted or to imitate the roughness of fractures. If the ground covering element 2 is made of concrete, for example, they can be formed without any difficulty during manufacture by use of a molding ram which has a complementary relief. The surface structures of individual raised portions 14 may differ, for example, not only by the size and depth of the pitted pattern or the like but, for instance, also by a different direction of the pitted pattern, as seen from above. As regards details of the format of the raised portions 14 and 14' as well as the arrangement and course of the dummy gaps 18, reference is made expressly to FIG. 1.

Figure 3:
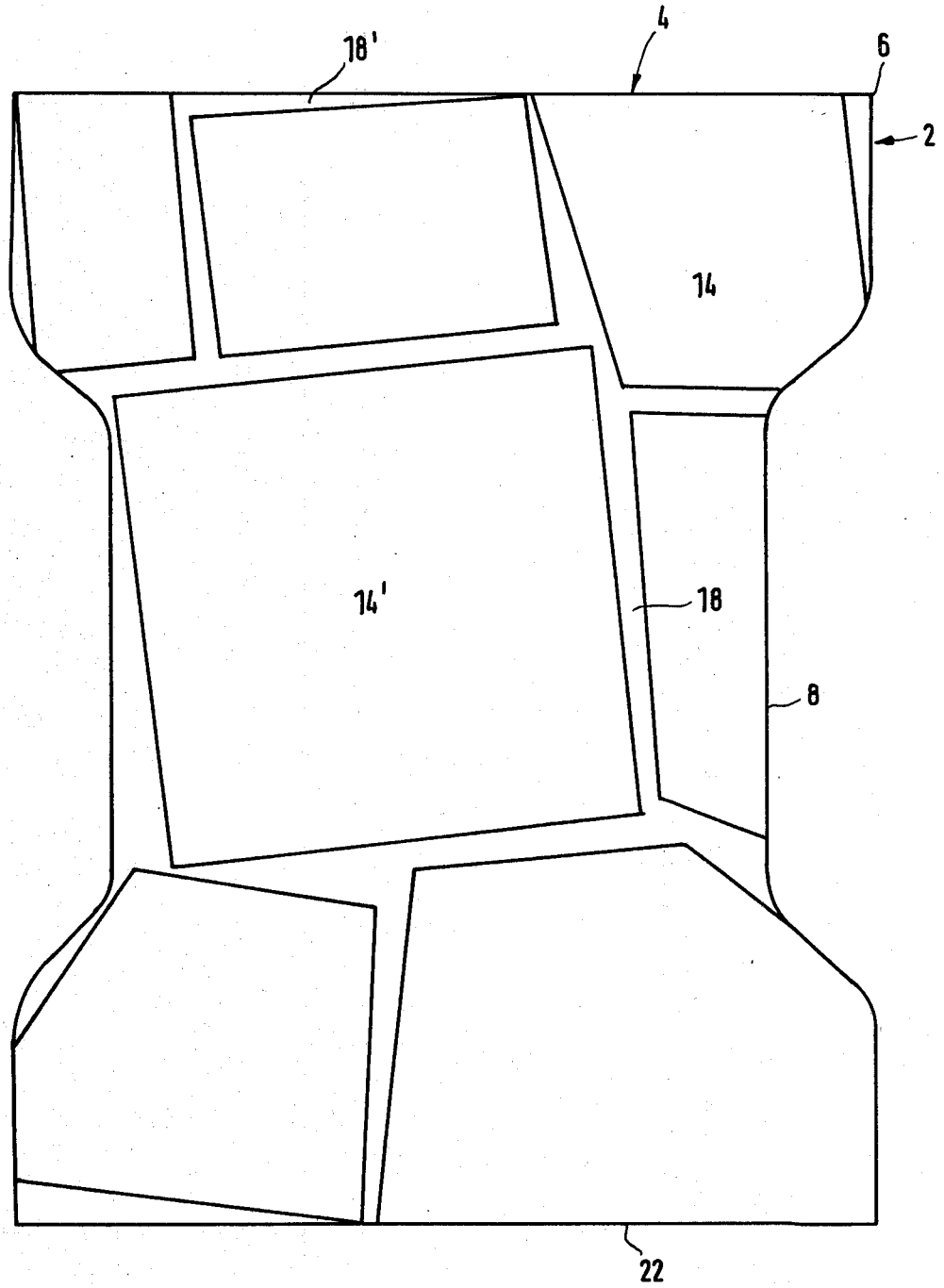
FIGS. 3 and 4 are top views of two further ground covering elements.

The contour 4 of the ground covering element 2 shown in FIG. 3 may be figured as resulting from a rectangular basic form. At each longitudinal side of this basic rectangle there is a recess 8 having a rectilinear base and a rounded transition into the remainder of the contour 4 so that the resulting contour 4, on the whole, has the shape of a doggy bone. Each recess 8 is so long that two further ground covering elements 2 can be laid adjacent one longitudinal side of the ground covering element 2, each offset by half the length of the ground covering element and each extending with its wider head or foot zone into the recess 8.

The ground covering element 2 shown in FIG. 3 has seven raised portions 14, among them one raised portion 14' of approximately square shape. These raised portions 14 and 14' are separated from one another by dummy gaps 18. As regards the exact shape of the raised portions 14 and 14' and the course of the dummy gaps 18, reference is expressly made to FIG. 3.

Contrary to the design of FIG. 1, the edges 22 of the raised portions 14 facing the contour 4 coincide with the contour 4 at several locations so that there are no marginal dummy gaps 18' at these locations.

Figure 4:
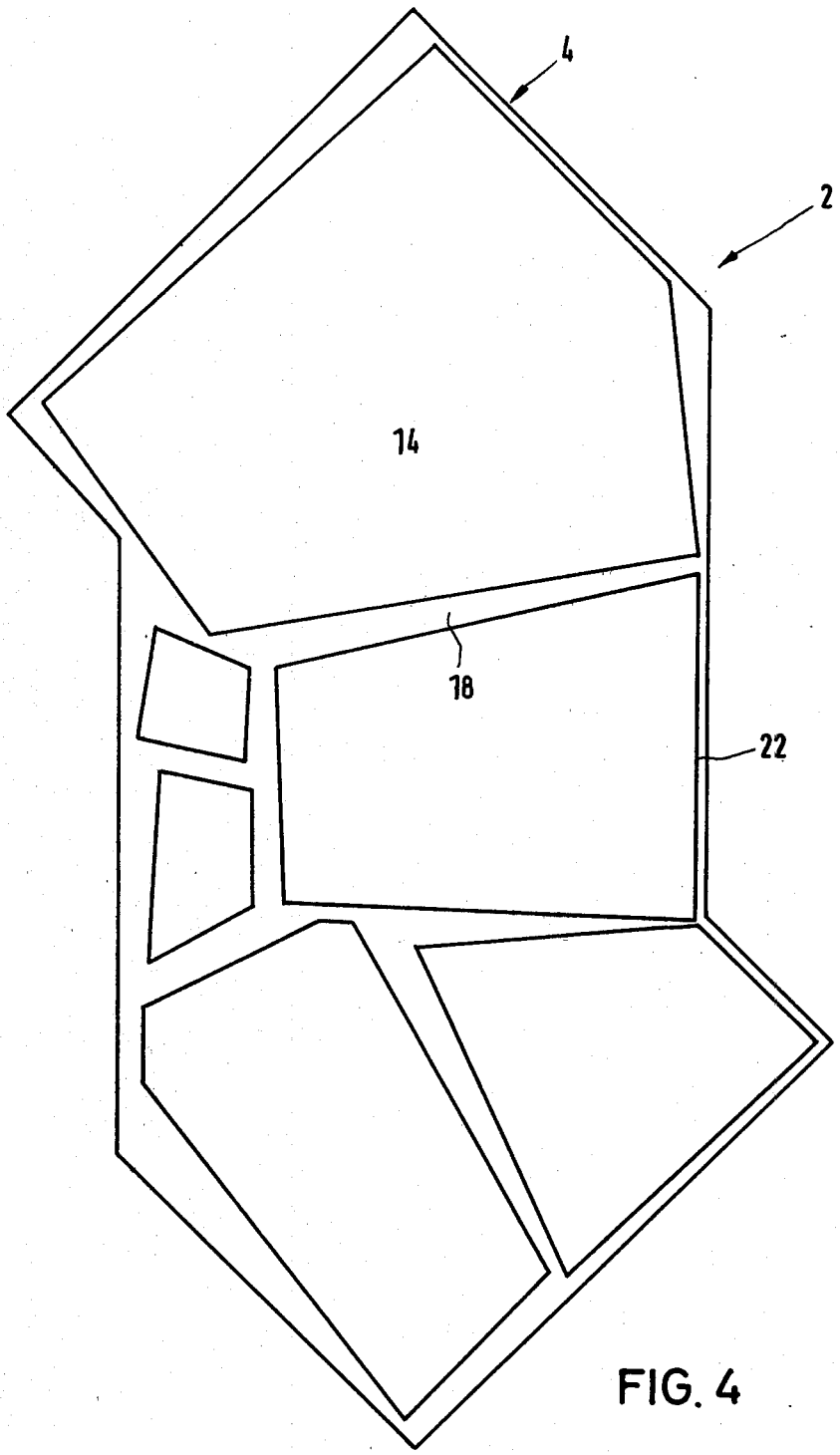

The contour 4 of the ground covering element 2 as shown in FIG. 4 may be figured as having resulted from a rectangular contour 4 of which the upper end the longitudinal direction has been turned to the left, as seen in FIG. 4, and the lower end zone in the longitudinal direction, as seen in FIG. 4, has been turned to the right, each by the same angle. In general, this produces an approximate Z-shaped configuration of the ground covering element 2. The contour 4 of the ground covering element 2 shown in FIG. 4 has been described in detail in German patent DE-PS No. 960 359.

The ground covering element 2 shown in FIG. 4 has six raised portions 14 separated from one another by dummy gaps 18. As regards the shape of the raised portions 14 and the course of the dummy gaps 18, express reference is made to FIG. 4.

In a manner similar to the ground covering element 2 according to FIG. 3 some of the raised portions 14 extend with their edges 22 facing the contour 4 up to the contour 4.

The ground covering elements 2 shown in FIGS. 3 and 4 have no interruptions 30 as does the ground covering element shown in FIG. 1.

Figure 5:
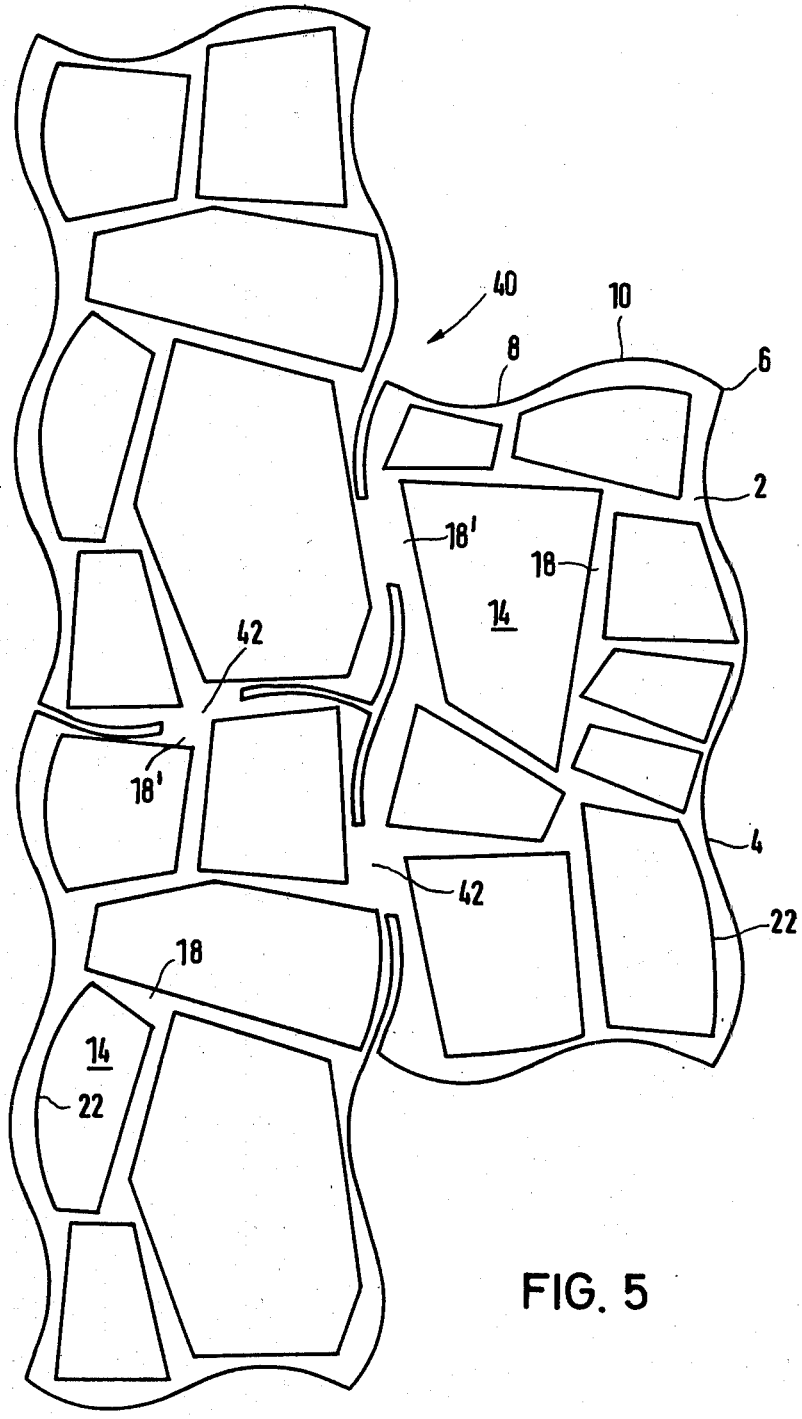
FIG. 5 is a top view of a ground covering element group.

FIG. 5 shows a ground covering element group 40 composed of three ground covering elements 2 of the same format. the three ground covering elements 2 also have projections and recesses 10 and 8, respectively, with respect to a baseline of a rectangle not shown and connecting the outer corners 6 of the respective ground covering element 2. The baseline rectangle is twice as long as it is wide. In this embodiment the projections and recesses 10 and 8 each are limited by a sinuous line starting from one outer corner 6. Each longitudinal side has two rounded recesses 8 and two rounded projections 10, and each transverse side has one rounded recess 8 and one rounded projection 10. Apart from this different contour 4, the individual ground covering elements 2 are of similar configuration as the ground covering element 2 shown in FIG. 1 so that details need not be described again. However, the raised portions 14 and the dummy gaps 18 have different dimensions. As regards these dimensions, reference is expressly made to FIG. 5. Furthermore, although no interruptions 30 are shown, these are conceivable.

Two of the ground covering elements 2 forming the group 40 are identical and arranged with their transverse sides against each other in the ground covering element group. The third ground covering element 2 of the ground covering element group 40 is offset with respect to the two other ground covering elements by one half of the length. One longitudinal side of this ground covering element 2 is positioned opposite one half of one longitudinal side of an adjacent ground covering element 2 and opposite one half of one longitudinal side of the other adjacent ground covering element 2. The three ground covering elements 2 of the ground covering element group 40 are joined by the fact that each ground covering element 2 is connected with the two adjacent ground covering elements 2 by two material connections 42 each. These material connections 42 each are located approximately in the middle of the contour areas along which the two ground covering elements 2 placed side by side are adjacent each other. In the present example the material connections 42 take up about one third of the length of these neighboring lengths.

In the ground covering element group 40 shown the material connections 42 as well as the ground covering elements 2 themselves are made of concrete. They are just as high as the marginal dummy gaps 18' next to them; yet they may also be lower.

As regards the configuration of the raised portions 14, it should be pointed out that some of them have the edge 22 facing the contour 4 rounded so as to be roughly adapted to the course of the contour. Yet this is not the case with all the respective edges 22. For more detailed information express reference is made to FIG. 5.

FIG. 5 shows a ground covering element group 40 which consists of three ground covering elements 2. It is obvious that the group may also comprise a greater number of ground covering elements 2 and that a different kind of mutual association of the ground covering elements 2 may be chosen. A particularly preferred correlation is that of a herringbone pattern.

As the material connections 42 take up only part of the length available for connecting the individual ground covering elements 2, they present facultative breaking zones at which the ground covering element group 40 will disintegrate into the individual ground covering elements 2 when a certain limit load is surpassed.

The ground covering element groups in accordance with the invention may also comprise ground covering elements which are not of the same kind and/or have an irregular contour. The break-throughs between the individual ground covering elements may take an irregular course.

What we claim is:

1. A ground covering element adapted for positioning adjacent another ground covering element, comprising: a top surface, a bottom surface substantially parallel to said top surface and a lateral surface substantially perpendicular over its entire length to said top and bottom surfaces, the outer contour of the ground covering element forming projections and recesses about said entire periphery, said contour having corner projections which form the vertices of a rectangle and line portions all of which are oblique to the sides of said rectangle connecting said corner projections, at least two of the line portions connecting each of said vertices being of equal length and the remaining line portions having lengths which are integer multiples of the lengths of said at least two line portions of equal length; said element comprising a plurality of irregular spaced polygons projecting from said top surface to form raised portions, the majority of said polygons differing in shape from each of the other of said polygons; the edges of said raised portions being straight and separated from each other by dummy gaps having widths which vary linearly along the entire length thereof and from the periphery of said ground covering element by marginal dummy gaps, the edge of each raised portion adjacent the periphery of said element substantially following the contour thereof and having a distance therefrom such that the average distance between the edge of said raised portion adjacent said periphery and said contour is approximately one-half the average width of said dummy gaps between said raised portions, sand filling the space between said adjacent ground covering elements thereby effectively concealing said space from view.

2. The ground covering element as claimed in claim 1 wherein at least part of the raised portions have an uneven, rough surface structure.

3. The ground covering element as claimed in claim 2 wherein said raised portions have a plurality of different surface structures.

4. The ground covering element as claimed in claim 1, 2 or 3 wherein said dummy gaps are of different depth.

5. The ground covering element as claimed in claim 1, 2 or 3 wherein at least one of said dummy gaps has a depth which varies along said gap.

6. The ground covering element as claimed in claim 5, wherein at least one of said dummy gaps extends from said top surface to said bottom surface of said ground covering element.

7. The ground covering element as claimed in claim 1, 2 or 3 wherein the regions of said ground covering element interconnecting said raised portions are facultative breaking zones.

8. A ground covering element group consisting of a plurality of ground covering elements as claimed in claim 1, 2 or 3 wherein all of said ground covering elements have the same contour.

9. A ground covering element group as claimed in claim 8 wherein the raised portions of said ground covering elements differ in at least one of shape and surface structure.

10. A ground covering element group as claimed in claim 8 wherein said ground covering elements are connected by material connections.

11. A ground covering element group as claimed in claim 10 wherein said material connections are facultative breaking zones.

* * * * *